US007309155B2

(12) United States Patent
Sarrouh et al.

(10) Patent No.: US 7,309,155 B2
(45) Date of Patent: Dec. 18, 2007

(54) TANK MIXING SYSTEM AND VALVE THEREFOR

(75) Inventors: Sami F. Sarrouh, Westlake, OH (US); Jose N. Hernandez, Cleveland, OH (US)

(73) Assignee: Consolidated Environmental Technologies, Ltd., Cleveland, OH (US)

( * ) Notice: Subject to any disclaimer, the term of this patent is extended or adjusted under 35 U.S.C. 154(b) by 383 days.

(21) Appl. No.: 10/866,227

(22) Filed: Jun. 12, 2004

(65) Prior Publication Data

US 2005/0111297 A1 May 26, 2005

Related U.S. Application Data

(60) Provisional application No. 60/506,425, filed on Sep. 26, 2003.

(51) Int. Cl.
*B01F 15/02* (2006.01)

(52) U.S. Cl. ..... 366/131; 366/134; 366/173.2; 366/177.1; 366/182.4; 366/184; 366/192

(58) Field of Classification Search ..... 366/137, 366/173.1, 131, 134, 173.2, 177.1, 182.4, 366/197; 137/590, 592; 251/12, 73
See application file for complete search history.

(56) References Cited

U.S. PATENT DOCUMENTS

| | | | | |
|---|---|---|---|---|
| 694,210 | A * | 2/1902 | Soellner | 366/269 |
| 1,716,294 | A * | 6/1929 | Bond | 366/134 |
| 4,580,597 | A * | 4/1986 | Cordingley et al. | 137/561 A |
| 4,609,010 | A * | 9/1986 | Watson | 137/587 |
| 4,987,922 | A * | 1/1991 | Andrepont et al. | 137/592 |
| 5,938,326 | A * | 8/1999 | Krivohlavek et al. | 366/137 |

FOREIGN PATENT DOCUMENTS

WO WO 2005/036048 * 4/2005

OTHER PUBLICATIONS

RED VALVE, Waterflex Check Valves, pp. 1-2, www.redvalvecom.
RED VALVE, Tideflex Check Valves, pp. 1-3, www.redvalve.com.
RED VALVE, Waterflex Check Valves, pp. 1-2, www.redvalvecom., no date.
RED VALVE, Tideflex Check Valves, pp. 1-3, www.redvalve.com., no date.

* cited by examiner

*Primary Examiner*—Tony G. Soohoo

(57) ABSTRACT

A mixing system and valve(s) are provided for a tank or other container of liquid to be mixed. A directional flow control valve is secured within the tank. The directional flow control valve includes a plate secured adjacent an inlet supply opening or an outlet supply opening in the tank. The valve plate has openings for enabling controlled maximum liquid flow into or out of the inlet supply opening or the outlet supply opening, respectively. A floating disc is also provided within the valve and located in an aligned position to enable sealing engagement of the floating disc over the plate openings when the flow control valve is in a closed position, and to enable movement of the floating disc away from the plate openings when the flow control valve is in an open position. An inlet and outlet supply is also provided to supply liquid into and out of the tank. The directional flow control valve is secured adjacent either an inlet and/or outlet supply and the tank. An inlet and outlet conduit is supported within the tank for receiving or providing liquid to the tank. Connected to the inlet and outlet conduit is an inlet and outlet distribution conduit, which extends from the inlet and outlet conduit and has inlet and outlet orifices located therein. Liquid is mixed within the tank when liquid is provided under pressure from the inlet supply into the tank via the inlet and outlet orifices, or when liquid is removed from the tank to the outlet supply via said inlet and outlet orifices under gravity or reverse pressure in pressurized vessels.

10 Claims, 7 Drawing Sheets

TANK MIXING SYSTEM AND VALVE THEREFOR

CROSS-REFERENCE TO RELATED APPLICATIONS

The present application claims priority from U.S. patent application Ser. No. 60/506,425 filed Sep. 26, 2003, the entire subject matter of which is incorporated herein by reference.

BACKGROUND OF THE INVENTION

1. Field of Invention

The present invention relates to a system for mixing liquid within a tank or reservoir, and more specifically to three dimensional system of inlet and outlet conduits in communication with a directional flow control valve, which conduits are arranged for distribution of the liquid within the tank or reservoir to obtain mixing during filling or draining.

2. Background of the Related Art

Since the early 1990's there has been increased concern regarding the water quality in potable water storage tanks and reservoirs. Short-circuiting between influent and effluent (meaning liquid inlet and outlet conduit(s)), and/or stratification of disinfectant residual concentration, or the water itself, can cause water quality problems due to water stagnation in such potable water supplies.

The United States Environmental Protection Agency ("EPA") regulates the potable water industry in the U.S. The EPA requires that water in tanks be completely turned over and replaced within a couple of days time to preserve and ensure water quality. Disinfectant residual levels within the water supply are also mandated by the EPA to remain above certain minimums to maintain potable water safety. Unfortunately, such measures have not been entirely successful, and water quality issues continue to be of concern for most potable water distribution systems.

During cold weather, where sufficient liquid turn over is not obtained, water within a tank may form ice. Such ice formation increases the potential for damage to the tank, as blocks of floating ice scrapes against the steel and rips protruding metal off walls of the tank. Ice damage is expensive and inconvenient to repair. Such repairs may require a water supply to be taken off line, which adds even further expense, as a substitute supply must be provided. By obtaining sufficient mixing or movement of the liquid within the tank, ice formation is minimized.

Additionally, there has also been an increased desire to obtain energy savings during the mixing of liquids in other liquid storage facilities, such as sewage, fuel or other chemical tanks or containers.

SUMMARY OF THE INVENTION

The present application provides an improved liquid mixing system using a directional flow control valve. The system includes inlet/outlet conduit(s) which are interconnected with the tank inlet/outlet(s) supply pipe(s) by at least one directional flow control valve of the present invention. Each of the inlet/outlet conduit(s) includes inlet/outlet distribution conduit(s) having inlet/outlet orifices. The conduit(s) and their respective orifices may serve as both the liquid inlets, which provide liquid into the tank, as well as the outlets which remove or drain liquid from the tank. The inlet/outlet conduit(s) and inlet/outlet distribution conduit(s) are arranged in three dimensional configurations as may be desired to distribute liquid to a particular location within the tank. Alternatively, a conventional inlet supply with an inlet conduit and inlet distribution conduit, and an outlet supply with an outlet conduit arrangement may be used. For ease of reference, it should be understood that the present system may make use of either common inlets and outlets, referred to as "inlets/outlets" which perform both processes of supplying and removing liquid, or to unique inlets and unique outlets, which perform only one process or the other, and that the differences between such systems are highlighted where relevant.

The improved system does not require the use of external energy for operation, such as recirculating pumps or mixers. The system makes use of the potential energy provided by the pressurized liquid entering the tank, and by gravity when liquid is leaving the tank or reverse pressure in pressurized vessels. Within a conventional tank, the potential energy of the incoming liquid would be lost once the liquid is exposed to the atmospheric pressure within the tank. The mixing effect of the present system is obtained as incoming liquid to the tank is provided from the inlet/outlet supply through the flow control valve into the inlet/outlet conduit(s) to the inlet/outlet distribution conduit(s) and through the inlet/outlet orifices. The system makes use of the momentum of the moving liquid as kinetic energy to close the flow control valve and move the liquid through the conduit(s) and out the orifice(s). Additional mixing is obtained upon draining of the tank when the flow control valve is opened and liquid is removed from the tank via the orifices to the distribution conduit(s) to the inlet/outlet conduit(s) and to the inlet/outlet supply pipe with the use of gravity or reverse pressure in pressurized vessels.

The directional flow control valve of the present improved mixing system is provided at the bottom of the tank and generally adjacent the inlet/outlet supply pipe and the inlet/outlet conduit(s). As a result, at least one valve is used in the present system, but more than one may be used, depending on the design of the inlet/outlet conduit(s) providing liquid to the tank as dictated by tank volume and flow rates. The valve is designed to operate automatically using the differential pressure of the moving influent and effluent liquid. The valve is submerged within the process liquid, and has a low profile to allow for maximum drainage of the tank or to meeting space constraints. The valve is formed by a plate secured over an opening in the bottom of the tank, and having openings formed in the plate for allowing passage of the influent and/or effluent liquid. Spaced from the plate, a floating disc is provided in a position aligned over the plate openings. The disc is secured to enable movement into or out of sealed engagement with the plate to resist or permit fluid flow through the plate openings, when positioned appropriately and upon the application of directional fluid pressure to the floating disc.

Advantages of the use of the present mixing system are that the mixing occurs during both filling and draining. Due to the three dimensional distribution of the inlet/outlet distribution conduit(s), during filling of the tank, mixing takes place due to the interaction of turbulent flow and streamlines throughout various elevations within the tank. During draining or drafting of the tank, liquid is mixed by combining flows from different areas and elevations throughout the tank. As a result, stratification of the liquid is reduced and the liquid within the tank is rendered more uniform. Ice formation is also reduced using the present system as previously mentioned, and overall, minimal maintenance of the system is required other than regular tank inspections.

The design of the present mixing system and valve may vary for different tank or reservoir styles and sizes or volumes. Each tank mixing system may be varied to accommodate different piping sizes, elevations, locations, pressures, the number and diameter of inlet/outlet supply pipes, and tank supports. The modularity of the present system enables the assembly of any desired three dimensional configuration to obtain the desired mixing of the liquid.

These and other advantages and features of the mixing system of the present application will be better understood from the detailed description of an embodiment of the system which is described in conjunction with the accompanying drawings.

DETAILED DESCRIPTION OF THE DRAWINGS

Figure 1:
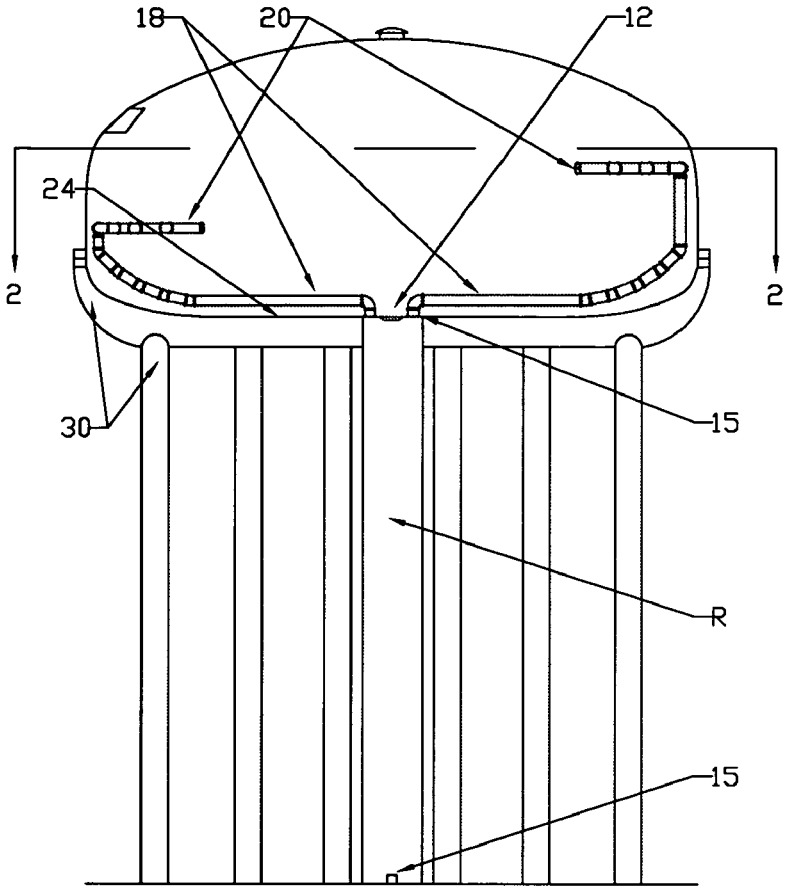
FIG. 1 is a schematic cut-away side view of a liquid container or tank having the mixing system and valve of the present application.
Figure 2:
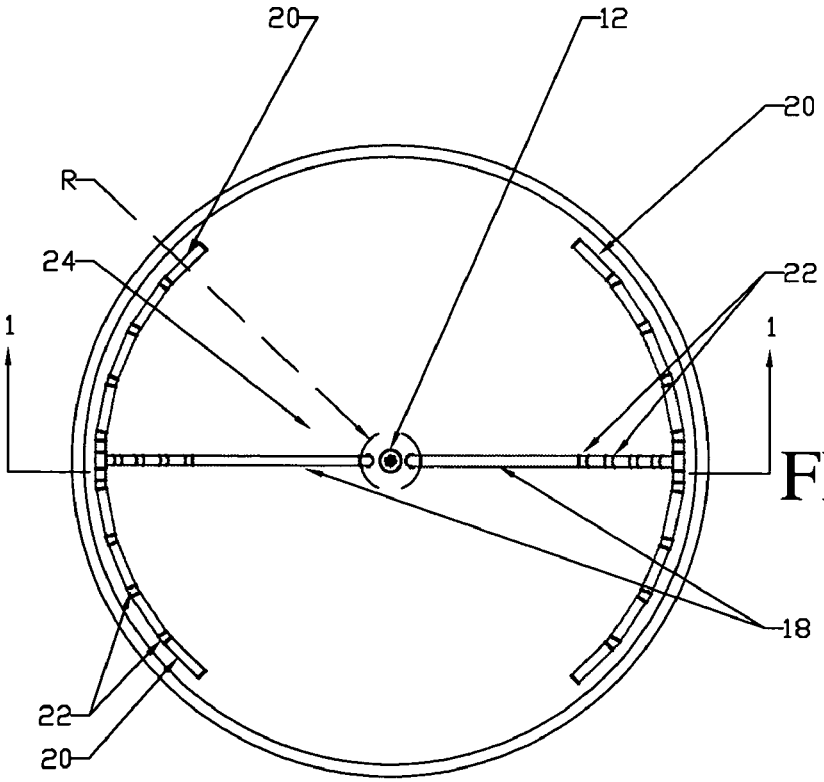
FIG. 2 is a schematic cut-away top view of the tank with the mixing system and valve of the present application, and taken along the line 1-1 of FIG. 1.
Figure 3:
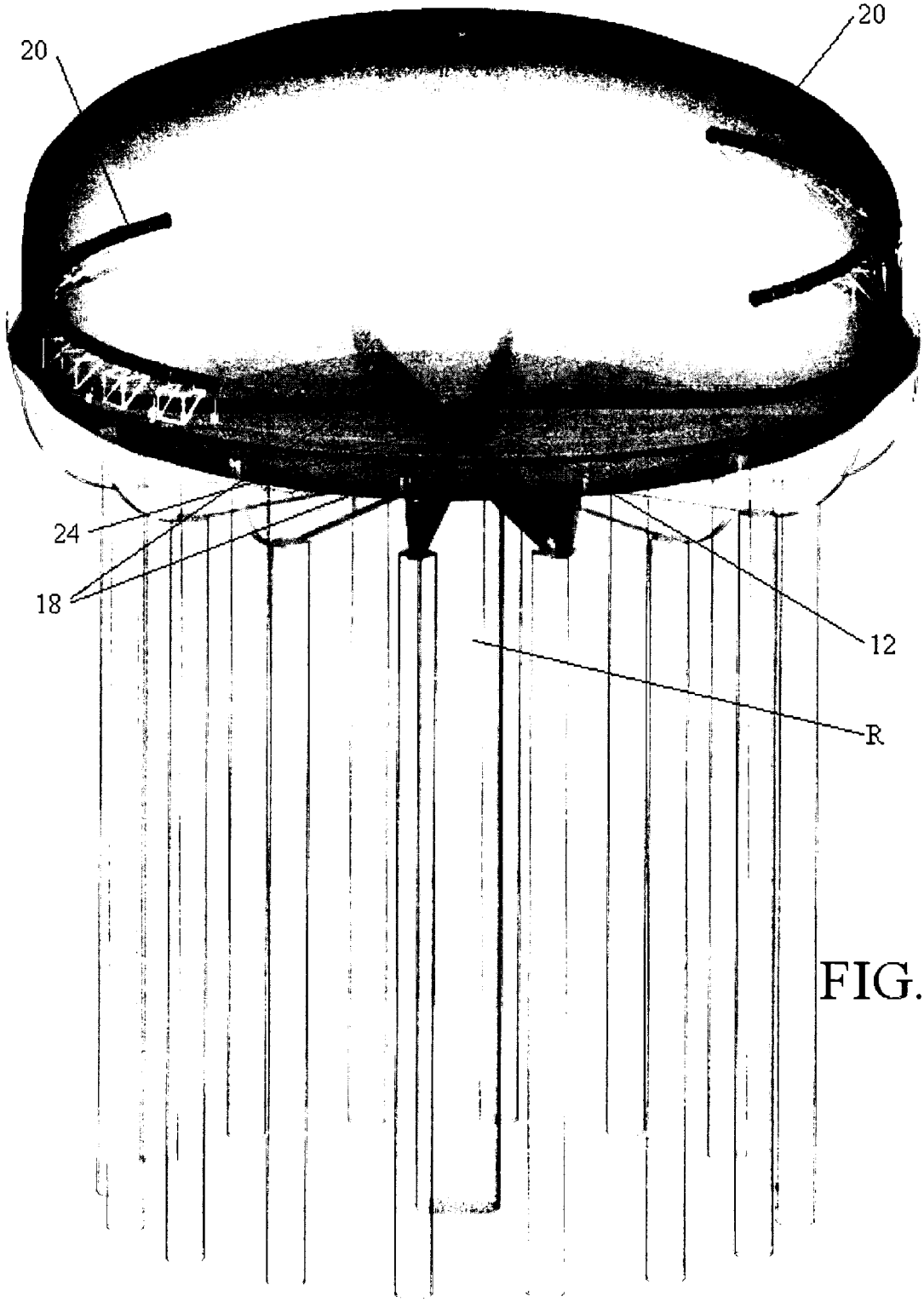
FIG. 3 is schematic perspective view of the tank with the mixing system and valve of FIG. 1.
Figure 5:
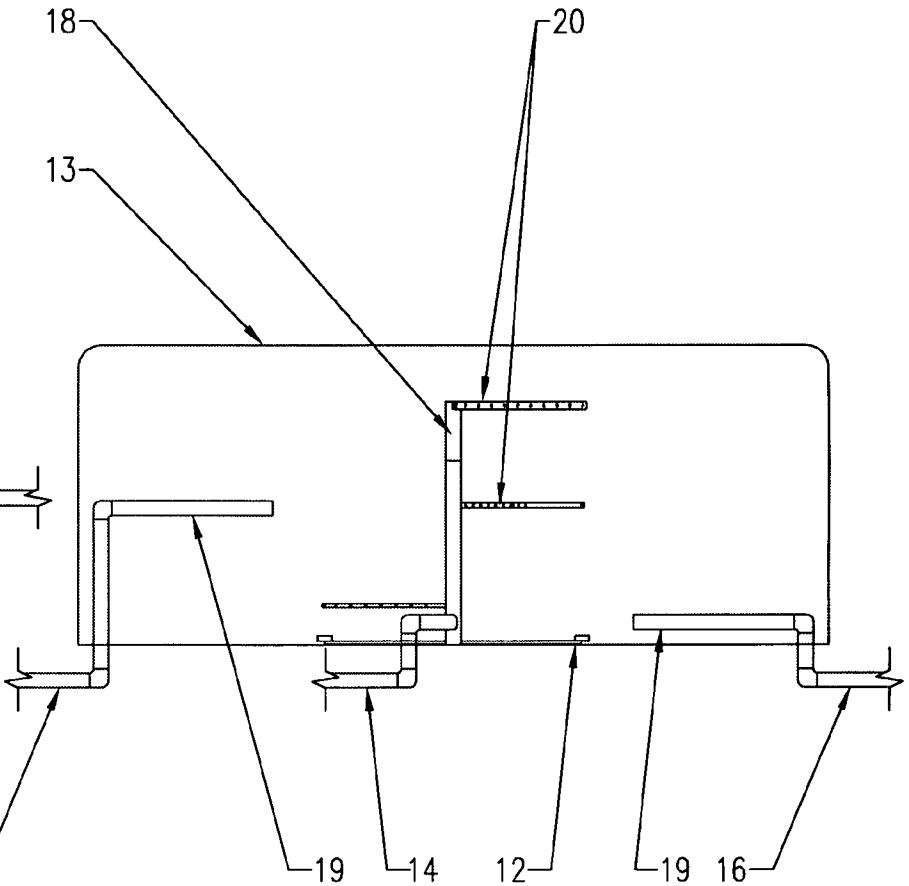
FIG. 5 is a schematic cut-away side view of FIG. 4.
Figure 4:
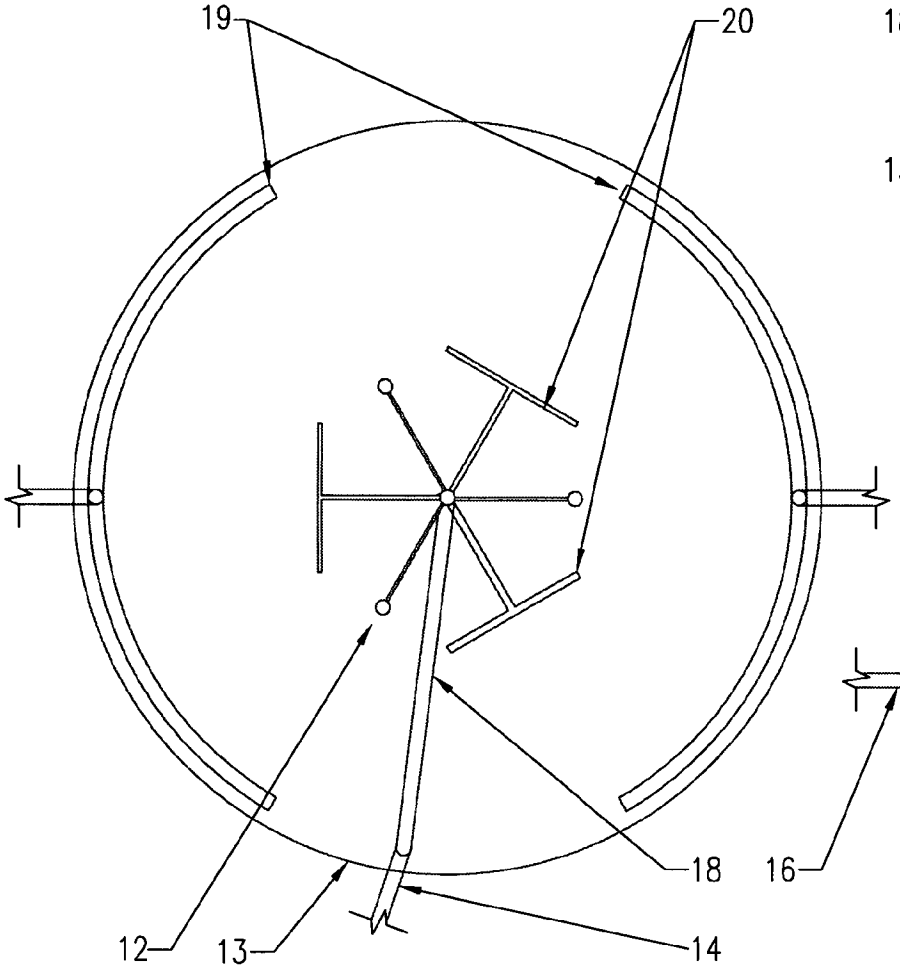
FIG. 4 is a schematic top plan view of a large ground tank having an embodiment of the tank mixing system and valve of the present application.

Turning now to the embodiment of FIGS. 1-3 of the present application, which illustrates an improved liquid mixing system 10 using a directional flow control valve 12 in the form of a water tank application. The illustrated tank or fluid container 13, is provided with influent fluid via inlet/outlet pipe or supply 15. Intermediate the tank 13 and the inlet/outlet supply 15, a wet riser or standpipe R is illustrated where liquid is mixed before being provided to the tank or after being removed from the tank. In the FIG. 1 embodiment, effluent liquid is removed from the tank via both the inlet/out conduits 18, as well as through a single directional flow control valve 12 which is secured to the bottom 24 of the tank 13. Each of the inlet/outlet conduits 18 is also in fluid communication with the wet riser R. Liquid exiting the tank 13 via the flow control valve 12 is provided directly to the wet riser R where it is mixed with fluid being removed to the riser R via the inlet/outlet conduits 18, before being removed via the inlet/outlet supply 15. Inlet/outlet orifices 22 are provided in the inlet/outlet conduits 18 and the inlet/outlet distribution conduits 20, which are in fluid communication. The inlet/outlet orifices 22 serve as both the liquid inlets to provide liquid into the tank, as well as the liquid outlets which remove liquid from the tank. Thus, when the inlet/outlet supply is serving as an outlet supply, the illustrated embodiment of FIGS. 1-3 includes three effluent outlets 18, 12 for removing liquid from the tank 13. When the tank 13 of FIGS. 1-3 is being filled, two influent inlets 18 are providing liquid. Conversion of an inlet/outlet supply 15 between performance as an influent line or an effluent line is provided by conventional valve mechanisms positioned upstream from the inlet/outlet supply 15.

As best shown in FIG. 3, the inlet/outlet conduits and inlet/outlet distribution conduits are arranged in three dimensional configurations as may be desired to distribute liquid to a particular location within the tank. The system 10 does not require the use of external energy sources to operate recirculating pumps or mixing devices. The system 10 uses of the potential energy provided by the pressurized liquid entering the tank 13, and by gravity when liquid is leaving the tank or by reverse pressure in pressurized vessels. The present system results in very little differential pressure loss during operation. For example, approximately less than 1 psi may be lost within the system during operation to remove or supply fluid to the tank, reservoir or other fluid container.

To mix fluid using the illustrated system of FIGS. 1-3, incoming liquid is provided from the inlet/outlet supply 15 to the inlet/outlet conduits 18 via riser R, to the inlet/outlet distribution conduits 20 and then into the tank through the inlet/outlet orifices 22. As the distribution conduits 20 are provided at various heights above the bottom 24 of the tank 13, mixing of the fluid is provided at various levels or zones within the tank. Mixing is also accomplished by draining liquid from the tank. In the illustrated embodiment, upstream movement of the inlet/outlet supply 15 to a condition for receiving effluent, results in a pressure change which operates the flow control valve 12 to withdraw fluid through the valve 12, as well as through the inlet/outlet orifices 22 to the distribution conduits 20 and inlet/outlet conduits 18 to riser R. The pressure change may be enabled by either gravity or using reverse pressure in a pressurized vessel.

It should be understood that the fluid containers within which the present mixing system may be used may be manufactured of any material. For example, fluid containers may be of steel, stainless steel or other galvanic corrosion resistant materials, metallic materials (aluminum as one possible example) coated with Teflon® or other polymeric coatings, as well as polymer materials such as polyvinyl chloride. Additionally, it should be understood that the conduit used within the present system may also be of any of the above mentioned materials: steel, stainless steel or other galvanic corrosion resistant materials, metallic materials (aluminum as one example) coated with Teflon® or other polymeric coatings, as well as polymer materials such as polyvinyl chloride.

Figure 7:
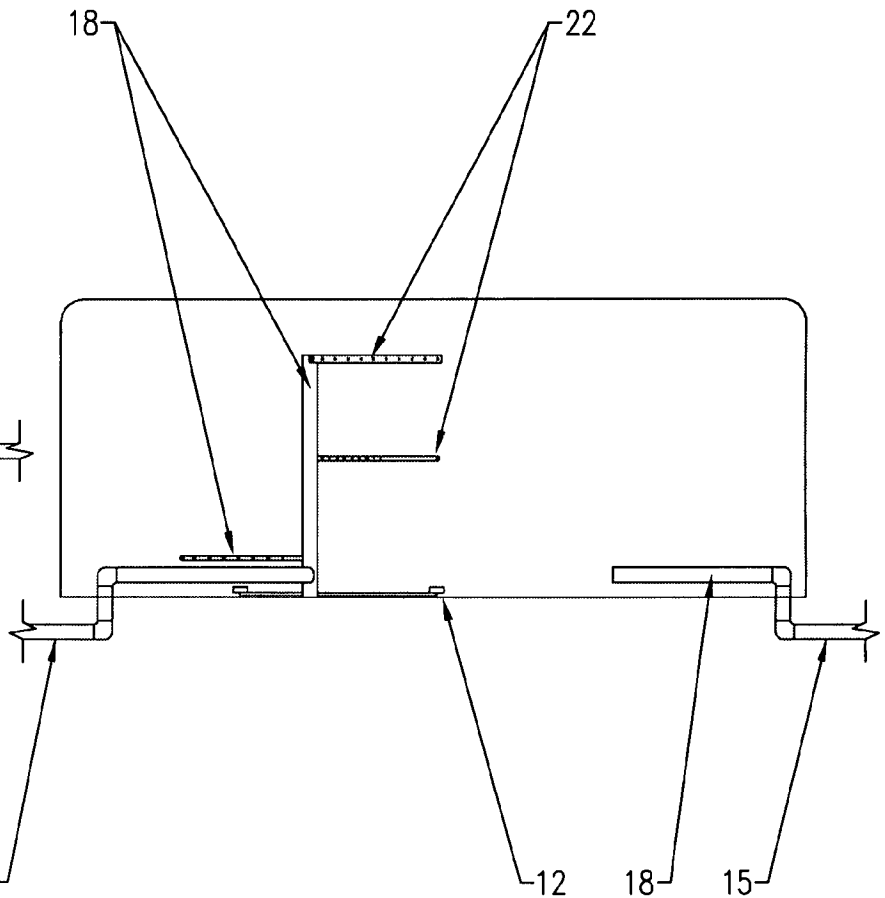
FIG. 7 is a schematic cut-away side view of FIG. 6.
Figure 6:
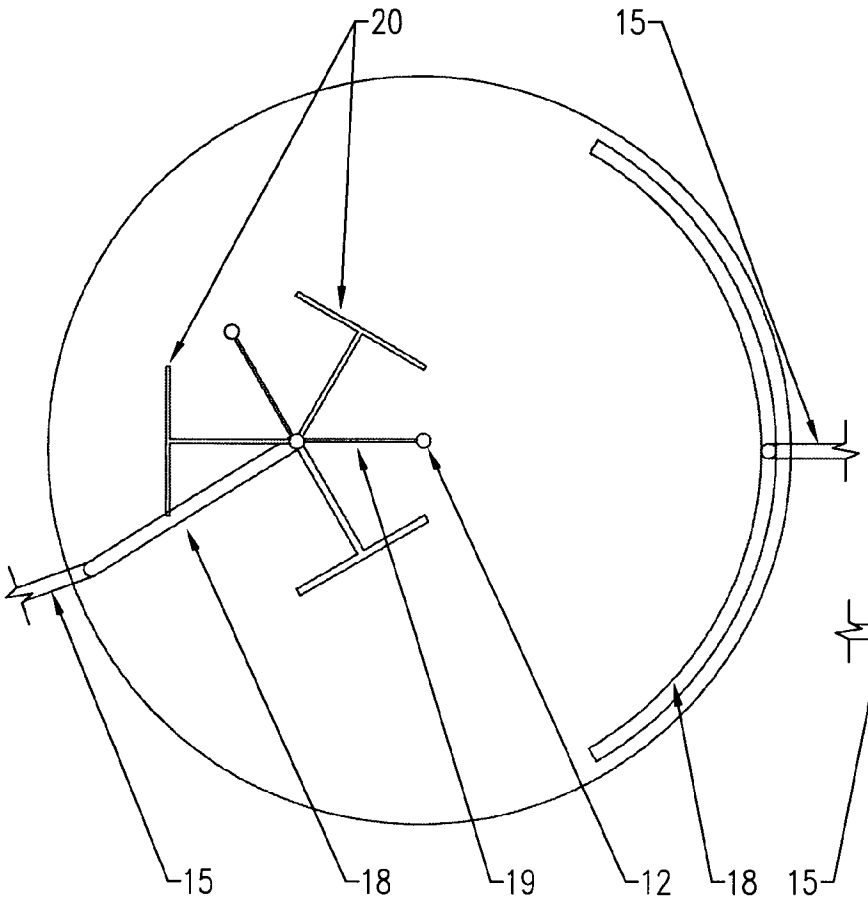
FIG. 6 is a schematic top plan view of a medium tank having an embodiment of the tank mixing system and valve of the present application.
Figure 9:
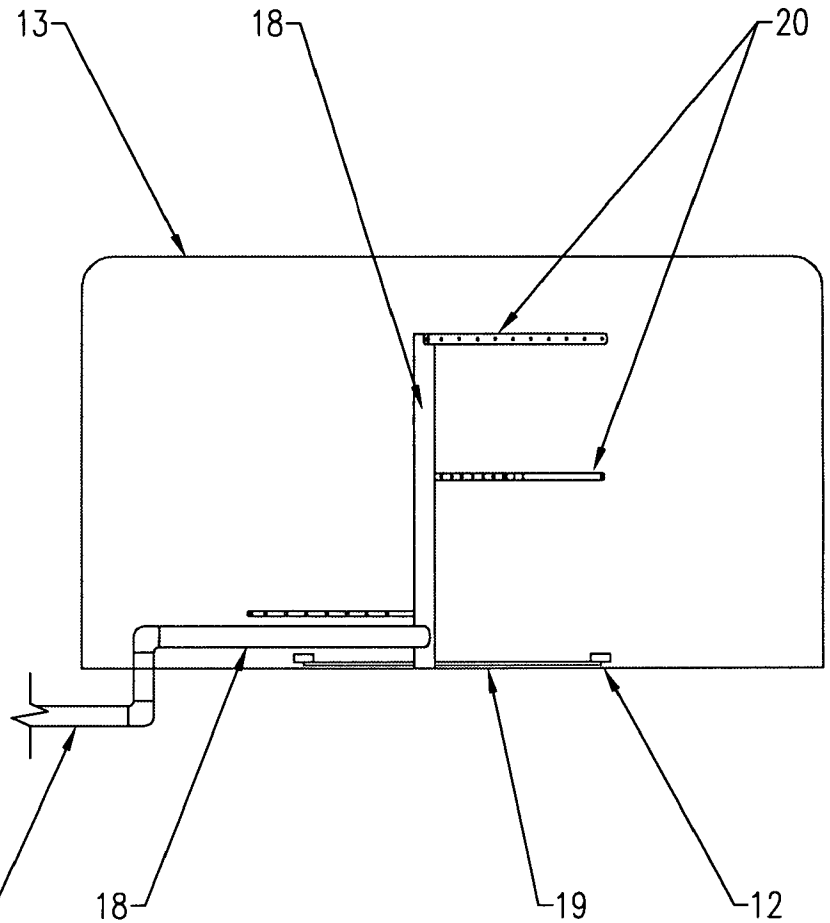
FIG. 9 is a schematic cut-away side view of FIG. 8.
Figure 8:
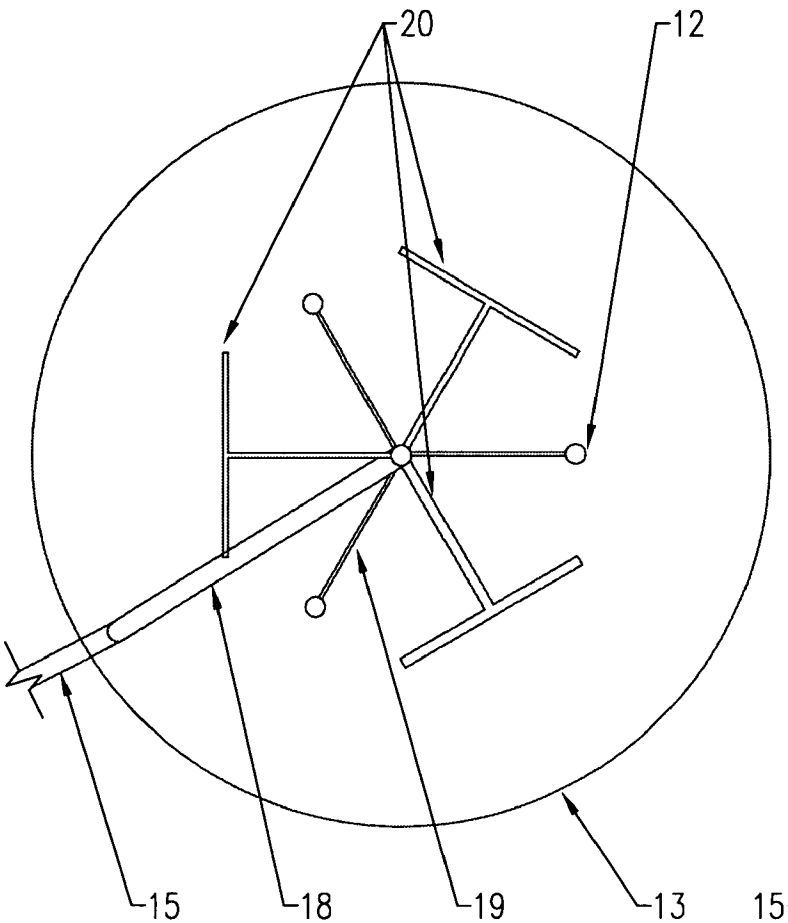
FIG. 8 is a schematic top plan view of a smaller tank having an embodiment of the tank mixing system and valve of the present application.
Figure 11:
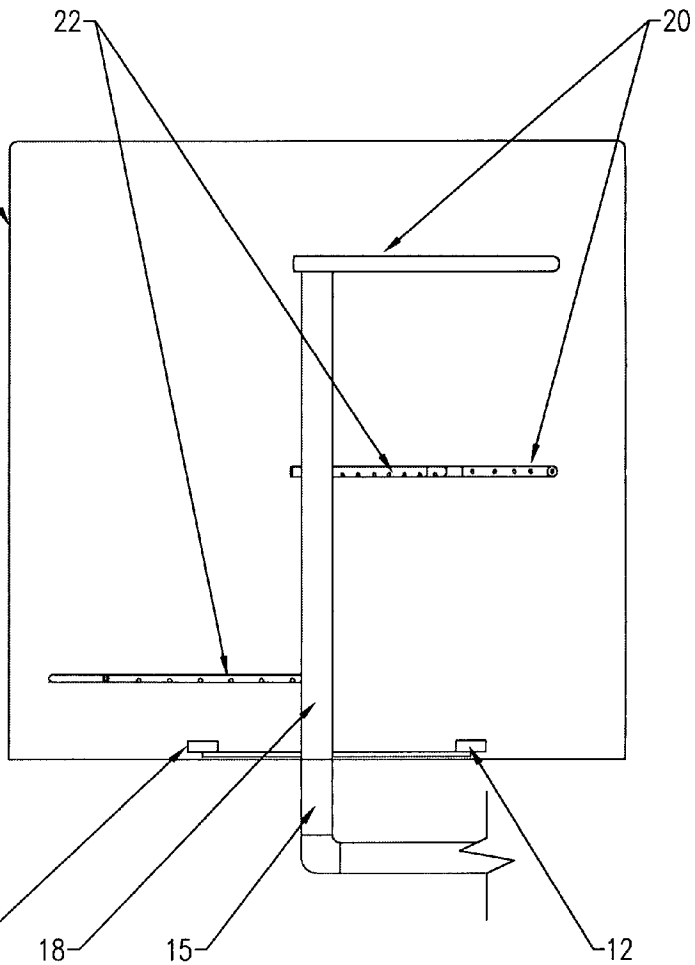
FIG. 11 is a schematic cut-away side view of FIG. 10.
Figure 10:
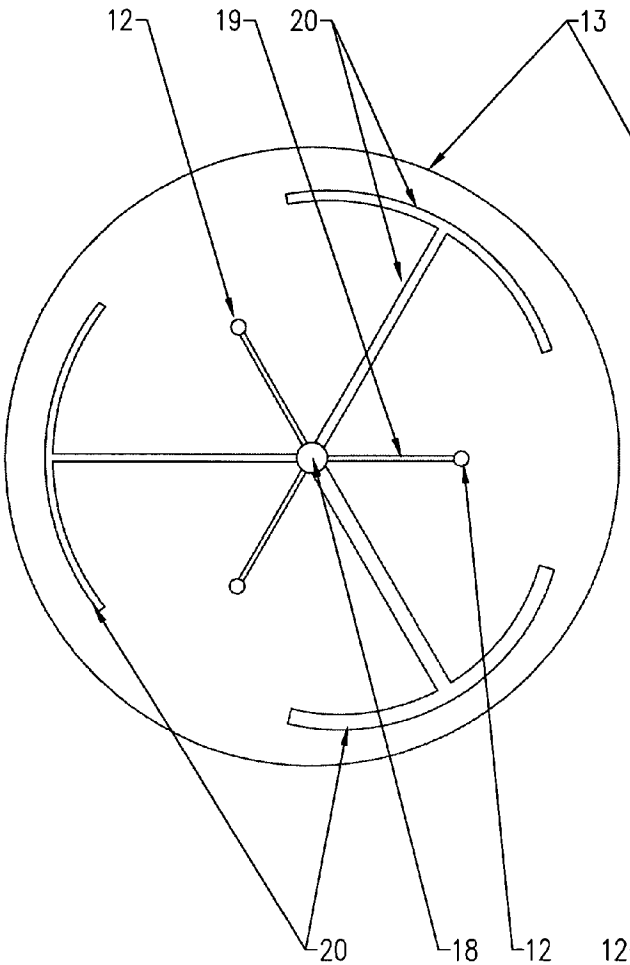
FIG. 10 is a schematic top plan view of a standpipe embodiment of the tank mixing system and valve of the present application.
Figure 15:
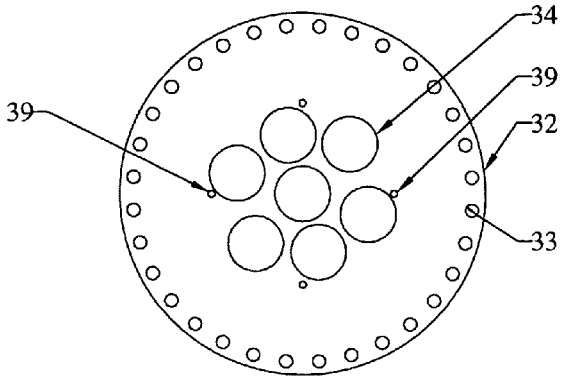
FIG. 15 is a top view of the valve plate of the directional control flow valve of the present application.

The sizes of the conduit used in the mixing system of the present application may also be of a wide range. The factors which may influence the size of conduit used include the elevation of the fluid container, its geographic location, the pressure within the fluid container, the fluid being mixed, the number and diameter of inlet/outlet supply pipes, and the supports used to maintain the position of the tank. For example, in very large reservoir applications, conduit size may be as large as 96 inches in diameter. However, in very small tank applications, conduit size may be as small as 1 inch in diameter. In the embodiments of the mixing system illustrated, the larger fluid containers are shown in FIGS. 1-5, medium fluid containers in FIGS. 6-7, smaller fluid containers in FIGS. 8-9 and a standpipe application in FIGS. 10-11. Conduit sizes used in these embodiments, for example, may range from 6 inches to 20 inches in diameter, but could be higher or lower depending on system factors. In FIG. 3, the inlet/outlet conduit is shown supported on the tank bottom 24. These figures also illustrate the variations in embodiments of the system which might be used. For example, the embodiments illustrated in these Figures may have numerous combinations of inlet supply 14, outlet supply 16 and/or inlet/outlet supply 15. Additionally, they may use inlet/outlet conduit 18 and/or outlet conduit 19. Inlet/outlet distribution conduit 20 having inlet/outlet orifices 22 may also be provided. In still another alterative embodiment, not illustrated, orifices 22 may be provided within inlet/outlet conduit 18. Additionally, arrangement of the conduits—both outlet conduit 19 and inlet/outlet conduit 18—may be configured to correspond to the internal shape of the tank, such as the partial hemispheric configuration shown. Inlet/outlet distribution conduit 20 may also be configured at a variety of angles which are transverse with respect to the inlet/outlet conduit 18. Such angles may be from 0 degrees to 90 degrees, and may be in any direction. The three dimensional arrangement or pattern of the conduits within the tank mixing system serves to direct fluid flow and distribute fluid to desired locations or zones which promote movement of the fluid within the tank and enable a more uniform consistency of the fluid being mixed.

One or more directional flow control valves 12 are also used in the present mixing system. As shown in FIGS. 1-3, a single large diameter flow control valve 12 may be used to communicate with an inlet/outlet supply 15. While in the embodiments of FIGS. 10-11, three flow control valves 12 are illustrated. These valves 12 are interconnected with outlet conduit 19 which is interconnected for communication with an inlet/outlet conduit 18 and an inlet/outlet supply 15. It should be understood that numerous combinations are possible depending on the design requirements desired in connection with the tank mixing system. However, at least one valve is preferably used.

The directional flow control valve 12 operates automatically upon the application of differential pressure from the moving influent or effluent liquid. The valve 12 is formed by a valve plate 32 secured over an opening 26 in the bottom 24 of the tank 13 in FIGS. 1-3 and 13, or to an outlet pipe 16 in FIGS. 6-12. The valve plate 32 may be of a variety sizes and materials as previously discussed, and in the illustrated embodiments is a 20 inch valve made of about ½ inch stainless steel. The valve plate 32 includes a flange with attachment openings 33 for securing to the bottom of a tank or an outlet supply, as well as multiple openings 34 for allowing fluid flow therethrough. Multiple openings 34 are believed to protect the physical integrity of the valve components over a single large opening. The illustrated embodiment preferably includes 7 openings having about 7 inch diameters, but may be of alternate designs with fewer, for example 5 openings, or more openings, where additional or reduced flow is desired.

Figure 14:
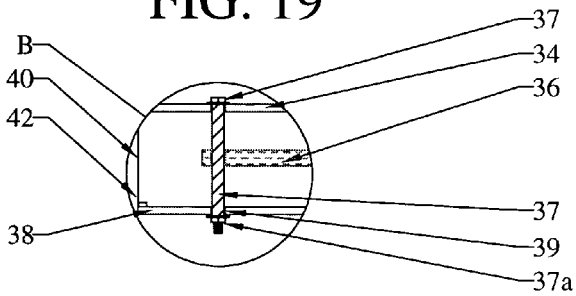
FIG. 14 is a schematic cut-away side view of the portion of the embodiment of the directional control flow valve referenced at B in FIG. 13.
Figure 17:
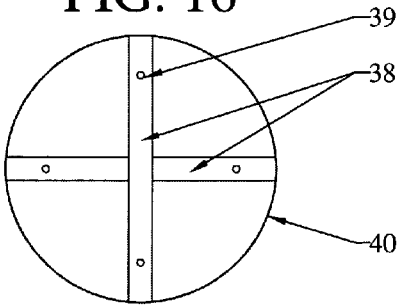
FIG. 17 is a top view of the support cross member of the directional control flow valve of the present application.
Figure 13:
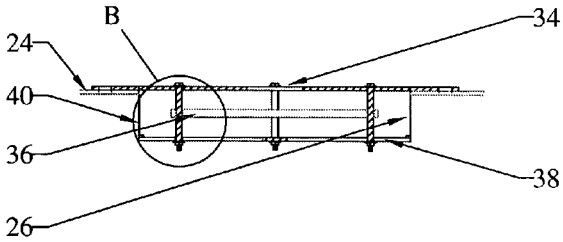
FIG. 13 is a schematic cut-away side view of another embodiment of the directional control flow valve of the present application taken approximately along the line A-A shown in FIG. 18.
Figure 18:
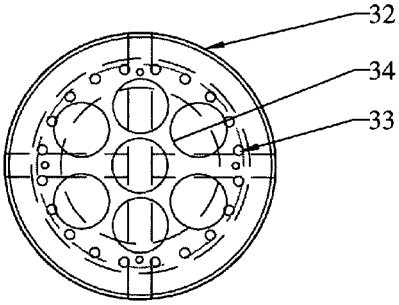
FIG. 18 is a schematic top view of the assembled directional control flow valve of the present application.
Figure 12:
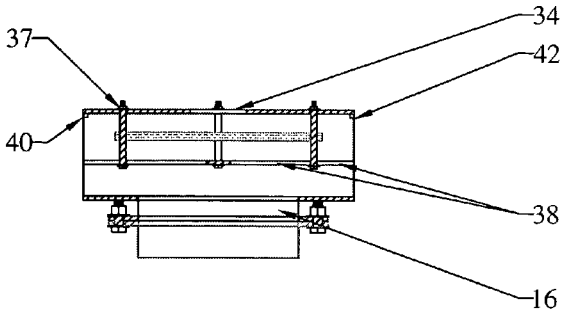
FIG. 12 is a schematic cut-away side view of an embodiment of the directional control flow valve of the present application.

The valve plate 32 is secured to a spool shaped valve body 40 as shown in FIGS. 12-14, which in the illustrated embodiment has a wall thickness of about 1/16 inch stainless steel. Spaced from the valve plate 32 is a support cross structure 38, which his also preferably of ½ inch thick stainless steel which are approximately 3 inches wide. The cross structure 38 is secured to the spool shaped valve body 40 at a weld located along a stainless steel hoop 42.

Figure 19:
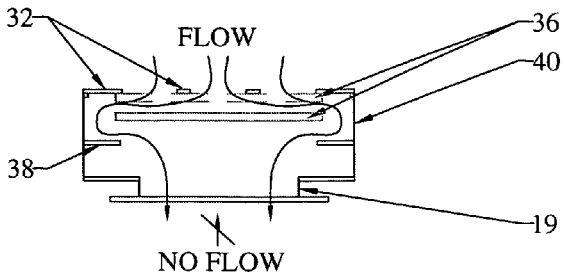
FIG. 19 is a schematic cut-away side view of the flow path of the directional control flow valve in the open position with the closed position shown in phantom.
Figure 16:
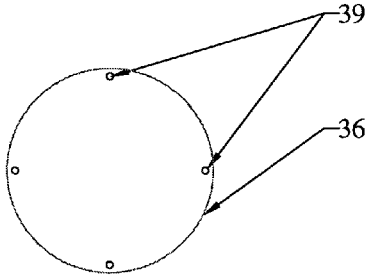
FIG. 16 is a top view of the floating disc of the directional control flow valve of the present application.

Intermediate the valve plate 32 and cross support 38 is a floating disc 36. The floating disc 36 is preferably of ultra high molecular weight polypropylene (UHMWP), and is supported for sliding movement on four ¾ inch stainless steel guide bolts 39. The UHMWP material is preferred for the floating disc in order to obtain the desired buoyancy of the disc, resistance to corrosion and mechanical degradation, as well as sealing engagement with the valve plate 32. However, additional light weight materials could also be used. The guide bolts 39 are engaged with the valve plate 32, floating disc 36 and the support cross 38, and secured in position via nuts 37*a*. Within the spool valve body, the guide bolts 39 may be provided with a cover or sleeve, or with an unthreaded section, to provide smooth sliding movement of the floating disc 36 along the guide bolts 39 into and out of engagement with the valve plate 32. The support cross 38 serves as a stop for the floating disc 36 when in the full open position under pressure of the effluent fluid as shown schematically in FIG. 19. The floating disc 36 is positioned for alignment and sealing engagement covering the plate openings 34 to prevent fluid flow into the fluid container when fluid flow is reversed to bias the floating disc against the plate openings 34, as schematically shown in phantom lines in FIG. 19.

Directional flow control valves 12 may be used in the horizontal positions illustrated in the present application, or may be provided at an angle with respect to the fluid flow. Additionally, the orientation of the valve may be inverted to obtain the desired valve operation or configuration with the mixing system.

While exemplary embodiments of the tank mixing system and valve have been described with a certain degree of particularity, it is the intent that the system include all modifications and alterations from the disclosed design falling within the spirit or scope of the appended claims.

We claim:

1. A liquid mixing system comprising, a container for liquid to be mixed, a directional flow valve in fluid communication with said liquid container, an inlet and outlet supply for providing liquid into and out of said liquid container, said directional flow valve in fluid communication with said inlet and outlet supply, an inlet and outlet conduit supported within said liquid container in fluid communication with said inlet and outlet supply for receiving or providing liquid to said liquid container, a first inlet and outlet distribution conduit extending from said inlet and outlet conduit at a first height above a bottom portion of the liquid container, and having inlet and outlet orifices located therein, a second inlet and outlet distribution conduit extending from said inlet and outlet conduit extending from said inlet and outlet conduit at a second height above a bottom portion of the liquid container, whereupon liquid is mixed within the liquid container when liquid provided under pressure from said inlet and outlet supply is provided into the liquid container via said inlet and outlet orifices, or when liquid being removed from the liquid container is provided to the inlet and outlet supply via said inlet and outlet orifices under gravity or reverse pressure in pressurized vessels.

2. The liquid mixing system of claim 1 wherein the inlet conduit is supported within said liquid container in a position extending away from a bottom portion of said liquid container.

3. The liquid mixing system of claim 2 wherein the inlet and outlet distribution conduit extends away from said inlet and outlet conduit.

4. The liquid mixing system of claim 3 wherein the inlet and outlet distribution conduit extends away from said inlet and outlet conduit at an angle of between 0 degrees and 90 degrees.

5. The liquid mixing system of claim 1 wherein the inlet and outlet conduit and the inlet and outlet distribution conduits are provided in a three dimensional arrangement within at least two different planes within the liquid container.

6. The liquid mixing system of claim 1 wherein said directional flow control valve includes a plate in fluid communication with an inlet supply and outlet supply adjacent the liquid container, said plate having openings therein for enabling controlled maximum liquid flow into or out of the inlet and outlet supply or an outlet supply, respectively, and a floating disc located in an aligned position to enable sealing engagement of the floating disc over the plate openings when the flow control valve is in a closed position, and to enable movement of the floating disc away from the plate openings when the flow control valve is in an open position.

7. The liquid mixing system of claim 1 wherein at least three inlet and outlet distribution conduits extend transversely from said inlet and outlet conduit.

8. The liquid mixing system of claim 7 wherein said inlet and outlet distribution conduits are configured having a central axis which corresponds generally with a portion of the internal shape of the liquid container.

9. The liquid mixing system of claim 7 wherein said first inlet and outlet distribution conduit includes first and second legs extending transversely and in a substantially opposite direction away from said inlet and outlet conduit at a first height above a bottom portion of the liquid container, and said second inlet and outlet distribution conduit includes first and second legs extending transversely and in a substantially opposite direction away from said inlet and outlet conduit at a second height above a bottom portion of the liquid container.

10. A liquid mixing system comprising, a container for liquid to be mixed having an inlet supply and an outlet supply, a directional flow valve secured adjacent said liquid container in fluid communication with said outlet supply, an inlet conduit supported within said liquid container for providing liquid into said liquid container, an inlet distribution conduit extending from said inlet conduit and having inlet orifices located therein, whereupon liquid is mixed within the liquid container when liquid provided under pressure from said inlet supply is provided into the liquid container via said inlet orifices, and an outlet conduit supported within said liquid container for receiving liquid when liquid is being removed from the liquid container and provided to the outlet supply under gravity or reverse pressure in pressurized vessels, said directional flow valve having a plate in fluid communication with said outlet supply, said plate having openings for controlling liquid flow out of the outlet supply using a floating disc located in an aligned position for sealing of the floating disc over the plate openings when the flow control valve is in a closed position, and to enable movement of the floating disc away from the plate openings when the flow control valve is in an open position.

* * * * *